US010602804B2

(12) United States Patent
Modena et al.

(10) Patent No.: US 10,602,804 B2
(45) Date of Patent: Mar. 31, 2020

(54) TENSIONING SYSTEMS FOR FOOTWEAR

(71) Applicant: Vans, Inc., Cypress, CA (US)

(72) Inventors: Tristan Modena, Cypress, CA (US); Jeff Grella, Cypress, CA (US)

(73) Assignee: Vans, Inc., Costa Mesa, CA (US)

( * ) Notice: Subject to any disclaimer, the term of this patent is extended or adjusted under 35 U.S.C. 154(b) by 0 days.

(21) Appl. No.: 15/433,755

(22) Filed: Feb. 15, 2017

(65) Prior Publication Data

US 2017/0156448 A1 Jun. 8, 2017

Related U.S. Application Data

(63) Continuation of application No. 14/652,257, filed as application No. PCT/US2013/075163 on Dec. 13, 2013, now Pat. No. 10,383,403.

(Continued)

(51) Int. Cl.

*A43B 5/04* (2006.01)
*A43C 1/00* (2006.01)

(Continued)

(52) U.S. Cl.

CPC ..... *A43C 11/165* (2013.01); *A43B 5/002* (2013.01); *A43B 5/0401* (2013.01);

(Continued)

(58) Field of Classification Search

CPC ..... A43B 5/04; A43B 5/0401; A43B 5/0443; A43B 5/0447; A43C 1/003; A43C 11/16; A43C 11/165; A43C 11/20

(Continued)

(56) References Cited

U.S. PATENT DOCUMENTS 4,748,726 A 6/1988 Schoch
5,341,583 A 8/1994 Hallenbeck (Continued)

FOREIGN PATENT DOCUMENTS

CN 1081597 A 2/1994
CN 101048998 A 10/2007

(Continued)

OTHER PUBLICATIONS

Notice of Final Rejection with English Translation in Korean Application No. 10-2015-7018445, dated May 25, 2017.

(Continued)

*Primary Examiner* — Sharon M Prange
(74) *Attorney, Agent, or Firm* — Ganz Pollard, LLC

(57) ABSTRACT

The inventive subject matter shown and described is directed to an item of footwear with a tensioning system, comprising: a shell for enclosing a foot and at least a portion of a lower leg; a pair of opposing edges generally aligned along the top of foot portion of the shell and/or a front lower leg portion, the edges generally aligning with a longitudinal axis of the foot and/or lower leg, the opposing edges defining opposite sides of the shell; a foot retraction system comprising a tension path and at least two anchor points disposed along the path on the opposite sides of the shell and supporting at least one tensionable cable section disposed along the path, at least one anchor point comprising a tensioning mechanism, the tensioning mechanism allowing for adjustable tensioning of the cable section, the anchor points being arranged on opposite sides of the shell that support the edges, at least one being on a lateral or medial side of a boot and not on the top of the foot and front of the lower leg, so that tensioning of the cable causes the opposing edges to converge together. The inventive subject matter is particularly suitable for use in boots for snow and skating (Continued)

sports or any other such sport where sliding movement of the foot or leg relative to the item of footwear is undesirable and where secure coupling of the item to the foot and leg facilitates transfer of power to a board, ski, skate blade, set of skate wheels, etc., that is coupled to the item.

21 Claims, 10 Drawing Sheets

Related U.S. Application Data

(60) Provisional application No. 61/866,533, filed on Aug. 15, 2013, provisional application No. 61/737,628, filed on Dec. 14, 2012.

(51) Int. Cl.
*A43C 11/16* (2006.01)
*A43C 11/20* (2006.01)
*A43B 5/16* (2006.01)
*A43B 5/00* (2006.01)

(52) U.S. Cl.
CPC ..... *A43B 5/0405* (2013.01); *A43B 5/0427* (2013.01); *A43B 5/0447* (2013.01); *A43B 5/0476* (2013.01); *A43B 5/16* (2013.01); *A43C 1/003* (2013.01); *A43C 11/20* (2013.01)

(58) Field of Classification Search
USPC ..... 36/117.1, 50.1, 50.5
See application file for complete search history.

(56) References Cited

U.S. PATENT DOCUMENTS

| | | | |
|---|---|---|---|
| 5,566,474 | A | 10/1996 | Leick et al. |
| 5,933,985 | A | 8/1999 | James |
| 5,937,542 | A | 8/1999 | Bourdeau |
| 5,940,990 | A | 8/1999 | Barret |
| 5,966,841 | A | 10/1999 | Barret |
| 6,073,370 | A | 6/2000 | Okajima |
| 6,076,241 | A | 6/2000 | Borel |
| 6,076,285 | A | 6/2000 | Caeran et al. |
| 6,119,372 | A | 9/2000 | Okajima |
| 6,267,390 | B1 | 7/2001 | Maravetz et al. |
| 6,367,169 | B1 | 4/2002 | Barret |
| 6,416,074 | B1 | 7/2002 | Maravetz et al. |
| 6,467,193 | B1 | 10/2002 | Okajima |
| 6,467,195 | B2 | 10/2002 | Pierre et al. |
| 6,473,999 | B2 | 11/2002 | Fellouhe |
| 6,532,688 | B2 | 3/2003 | Bouvier |
| 6,560,898 | B2 | 5/2003 | Borsoi et al. |
| 6,775,928 | B2 | 8/2004 | Grande et al. |
| 6,877,256 | B2 | 4/2005 | Martin et al. |
| 6,993,859 | B2 | 2/2006 | Martin et al. |
| 7,082,701 | B2 | 8/2006 | Dalgaard et al. |
| 7,134,224 | B2 | 11/2006 | Elkington et al. |
| 7,152,286 | B2 | 12/2006 | Rooney et al. |
| 7,159,340 | B2 | 1/2007 | Borsoi |
| 7,231,699 | B2 | 6/2007 | Borsoi |
| 7,281,341 | B2 | 10/2007 | Reagan et al. |
| 7,293,373 | B2 | 11/2007 | Reagan et al. |
| 7,360,282 | B2 | 4/2008 | Borsoi |
| 7,386,947 | B2 | 6/2008 | Martin et al. |
| 7,392,602 | B2 | 7/2008 | Reagan et al. |
| 7,401,423 | B2 | 7/2008 | Reagan et al. |
| 7,591,050 | B2 | 9/2009 | Hammerslag |
| 7,658,019 | B2 | 2/2010 | Reagan et al. |
| 7,818,899 | B2 | 10/2010 | Dinndorf et al. |
| 8,448,353 | B2 | 5/2013 | Seliger |
| 2003/0115777 | A1 | 6/2003 | Hall et al. |
| 2004/0074110 | A1 | 4/2004 | Borsoi |
| 2006/0037215 | A1 | 2/2006 | Lee |
| 2006/0174519 | A1 | 8/2006 | Peruzzo |
| 2006/0191164 | A1 | 8/2006 | Dinndorf et al. |
| 2008/0028641 | A1 | 2/2008 | Messmer |
| 2008/0083135 | A1 | 4/2008 | Hammerslag et al. |
| 2008/0163515 | A1 | 7/2008 | Rackiewicz et al. |
| 2011/0030244 | A1 | 2/2011 | Motawi et al. |
| 2013/0205622 | A1 | 8/2013 | Harald |

FOREIGN PATENT DOCUMENTS

| | | | |
|---|---|---|---|
| CN | 201948065 | U | 8/2011 |
| CN | 202184212 | U | 4/2012 |
| DE | 202008000952 | | 3/2008 |
| EP | 0923886 | | 12/2002 |
| EP | 1882420 | A1 | 1/2008 |
| EP | 1787541 | | 10/2011 |
| JP | H06284907 | | 10/1994 |
| JP | H0852002 | A | 2/1996 |
| JP | H08317809 | A | 12/1996 |
| JP | H10155515 | | 6/1998 |
| JP | H11206416 | A | 8/1999 |
| JP | 2004-41666 | | 2/2004 |
| JP | 3115773 | U | 11/2005 |
| JP | 2007136185 | A | 6/2007 |
| JP | 2013529994 | A | 7/2013 |
| RU | 2006112859 | | 11/2007 |
| SU | 1680036 | | 9/1991 |
| WO | WO2012001042 | | 1/2012 |

OTHER PUBLICATIONS

Office Action with English Translation for Korean Application No. 10-2015-7018445, dated Nov. 17, 2016.
Extended European Search Report for European Application No. 13862554.6, dated Oct. 28, 2016.
International Search Report and Written Opinion for PCT Application No. PCT/US2013/075163, dated Apr. 23, 2014.
Office Action for Canadian Application No. 2895246, dated Apr. 27, 2016.
Office Action with English Translation for Japanese Application No. 2015-548019, dated Aug. 4, 2016.
Non-Final Office Action in U.S. Appl. No. 14/652,257, dated Jun. 2, 2017.
Office Action in Canadian Application No. 2,895,246, dated Nov. 22, 2017, 3 pages.
Final Office Action in U.S. Appl. No. 14/652,257, dated Nov. 3, 2016, 18 pages.
Non-Final Office Action in U.S. Appl. No. 14/652,257, dated Apr. 11, 2016.
Chinese Office Action dated Feb. 20, 2017 in Chinese Application No. 2013800728296.
Canadian Office Action dated Jan. 30, 2017 in Canadian Application No. 2,895,246.
Japanese Office Action dated Jan. 4, 2017 in Japanese Application No. 2015-548019.
Chinese Office Action dated Jun. 1, 2016 in Chinese Application No. 2013800728296.
Final Office Action in U.S. Appl. No. 14/652,257, dated Mar. 8, 2018, 13 pages.
Non-Final Office Action in U.S. Appl. No. 14/652,257, dated Oct. 5, 2018, 10 pages.

TENSIONING SYSTEMS FOR FOOTWEAR

RELATED APPLICATIONS

This application claims the benefit of and priority to pending U.S. patent application Ser. No. 14/652,257, filed on Jun. 15, 2015, which claims the benefit of and priority to PCT Application Serial No. PCT/US2013/075163, filed Dec. 13, 2013, which claims the benefit of and priority to U.S. Provisional Patent Application Ser. No. 61/866,533, filed on Aug. 15, 2013, and U.S. Provisional Patent Application Ser. No. 61/737,628, filed on Dec. 14, 2012, which applications are hereby incorporated by reference in their respective entireties, for all purposes.

BACKGROUND

The inventive subject matter in its various possible embodiments is directed to systems that tension an item of footwear to the foot and/or leg of a user so that the foot or leg is secured within the item during use. The inventive subject matter is particularly suitable for use in boots for snow and skating sports or any other such sport where sliding movement of the foot or leg relative to the item of footwear is undesirable and where secure coupling of the item to the foot and leg facilitates transfer of power to a board, ski, skate blade, set of skate wheels, etc., that is coupled to the item. The inventive subject matter is particularly, but not exclusively, directed to a tensioning system for a snowboard boot that tightens the boot parts around the user's instep or other anatomical areas, retracting the foot into the footbed and simultaneously retracting the heel into the heel area. The system provides a tension path that achieves the foregoing results and routes one or more cables to a tensioning mechanism that can be operated by the user to adjustably increase or decrease cable tension.

Systems that include a tensionable band or cables over the instep of a boot are known in rigid shell ski boots, for example. The instep tensioning system retracts the foot downwardly against the footbed and rearwardly into the heel area of the footwear item. Such boots are made of stiffer plastic parts and have specially molded features for routing of tensioning cables. Such boots may not allow for easy or precise adjustment of the cable tension. The integration of such systems into boot may also pose manufacturing challenges and may be costly. Further, in the case of snowboard boots, the shells typically have opposing, spaced apart edges and a tongue disposed in the spaced area (sometimes referred to herein as a "gap"). In such boots, a lace or cable-based closure system may be used. Unfortunately, until the inventive subject matter, the integration of a separate instep tensioning system has proven challenging because the conventional closure system and the instep tensioning system may interfere with each other. For example, U.S. Pat. No. 7,386,947 shows a tensioning system using cords and a retractable reel mounted on the upper sides of the boot with the cable routing over the instep. However, the cords are routed using a cumbersome harness assembly disposed within the outer shell of the boot that adds bulk and expense. The system does not integrate directly with the outer shell parts for optimal engagement with those parts.

The foregoing is not intended to be an exhaustive listing of disadvantages of the prior art and needed improvements; it is only a sampling. In view of the foregoing, there is a substantial need for improved systems for tensioning items of footwear to the feet of users.

SUMMARY

Inventive subject matter disclosed herein overcomes one or more disadvantages of the prior art and provides various improvements. The inventive subject matter includes the embodiments disclosed herein, as well as various permutations of features that are within the scope and spirit of the disclosure and teachings of this document.

The following is a description of various inventive lines under the inventive subject matter. The appended claims, as originally filed in this document, or as subsequently amended, are hereby incorporated into this Summary section as if written directly in.

In certain representative embodiments contemplated herein, the inventive subject matter shown and described is directed to an item of footwear with a tensioning system, comprising: a shell for enclosing a foot and at least a portion of a lower leg; a pair of opposing edges generally aligned along the top of foot portion of the shell and/or a front lower leg portion, the edges generally aligning with a longitudinal axis of the foot and/or lower leg, the opposing edges defining opposite sides of the shell; a foot retraction system comprising a tension path and at least two anchor points disposed along the path on the opposite sides of the shell and supporting at least one tensionable cable section disposed along the path, at least one anchor point comprising a tensioning mechanism, the tensioning mechanism allowing for adjustable tensioning of the cable section, the anchor points being arranged on opposite sides of the shell that support the edges, at least one being on a lateral or medial side of a boot and not on the top of the foot and front of the lower leg, so that tensioning of the cable causes the opposing edges to converge together.

In the embodiments contemplated herein, the item of footwear may be a boot for a snow or skating sport. In the embodiments contemplated herein, a section of the tension path transversely crosses the instep area of the boot. In the embodiments contemplated herein, the tension path may include an anchor point disposed on the boot and positioned to provide a section of the cable an upward turn up the side of the item after the crossing the instep. In the embodiments contemplated herein, the tension path may continue to a position rearward that is longitudinally aligned with the ankle are of the boot. In the embodiments contemplated herein, the tension path may continue to an area that is vertically at about the ankle area. In the embodiments contemplated herein, the tension path may continue to a heel area of the boot. In the embodiments contemplated herein, the tension path on at least one side of the boot terminates at a tensioning mechanism disposed on the boot above the ankle area. In the embodiments contemplated herein, the tensioning mechanism may comprise a reel-base mechanism. In the embodiments contemplated herein, the tension path may transversely crosses the foot and continues rearwardly at about 20 to about a 70 degree angle from horizontal to apply a rearward and downward force vector on the foot or lower leg. In the embodiments contemplated herein, the tension element may cross over an instep area of the foot. In the embodiments contemplated herein, a tongue may be disposed on the boot in the space between the edges. In the embodiments contemplated herein, a section of the tension path may be disposed over the outer surface of the tongue. In the embodiments contemplated herein, the tension path may extend from the tongue below the outer surface of the outer shell. In the embodiments contemplated herein, closure system may be adjacently associated with the opposing edges, the system comprising a set of closure elements arranged along the edges. In the embodiments contemplated herein, the closure elements may be adapted to receive laces or other cables. In the embodiments contemplated herein, a liner in the nature of a removable bootie may be disposed in the shell. In the embodiments contemplated herein, the closure mechanism may include a wheel or knob operable by a user to tension the cable.

In the embodiments contemplated herein, a cable along the tension path may comprise: a loop having one end formed of two free ends coupled to a first anchor point comprising a tensioning mechanism disposed on one of the opposing sides of the boot, the tensioning mechanism being spaced away and rearward of the opposing edges associated with those sides, an opposite closed end of the loop engaging a second anchor point on the opposite side of the boot as the first loop, and also spaced away and rearward of the opposing edges, and wherein the tension path between the first anchor point and the second anchor point transversely crosses an instep area of the boot and is oriented to provide a section of cable on the path a downward and rearward force so that the sides and any tongue retract a user's foot into the boot's footbed and heel area.

These and other embodiments are described in more detail below and in the accompanying Figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The accompanying drawings in FIGS. 1 through 9 show embodiments according to the inventive subject matter.

FIGS. 1 through 9 show left boot embodiments. Left and right boots are mirror images of each other.

FIG. 1 shows a lateral perspective view of a boot with a tensioning system in an untensioned condition.

FIG. 2 shows a medial perspective view of the boot in FIG. 1

FIG. 3 shows another lateral view of the boot in FIG. 1, in this case with the tensioning system under tension and engaging boot parts.

FIG. 4 shows a partial front view of a left boot with another tensioning system in a tensioned condition.

FIG. 6 shows a shell of a left boot bisected along a plane dividing the medial side of the boot from the lateral side of the boot, revealing internal features of the shell and the tensioning system.

FIG. 7 shows a lateral, side elevation view of the boot shown in FIG. 4, with the tensioning system in a tensioned condition and a portion of the lateral eyerow folded down to reveal features of the tongue.

FIG. 8 shows a lateral view of the boot shown in FIG. 7 with the eyerow folded up.

FIG. 9 shows a lateral perspective view of the boot as shown in FIG. 8.

DETAILED DESCRIPTION

Figure 1:
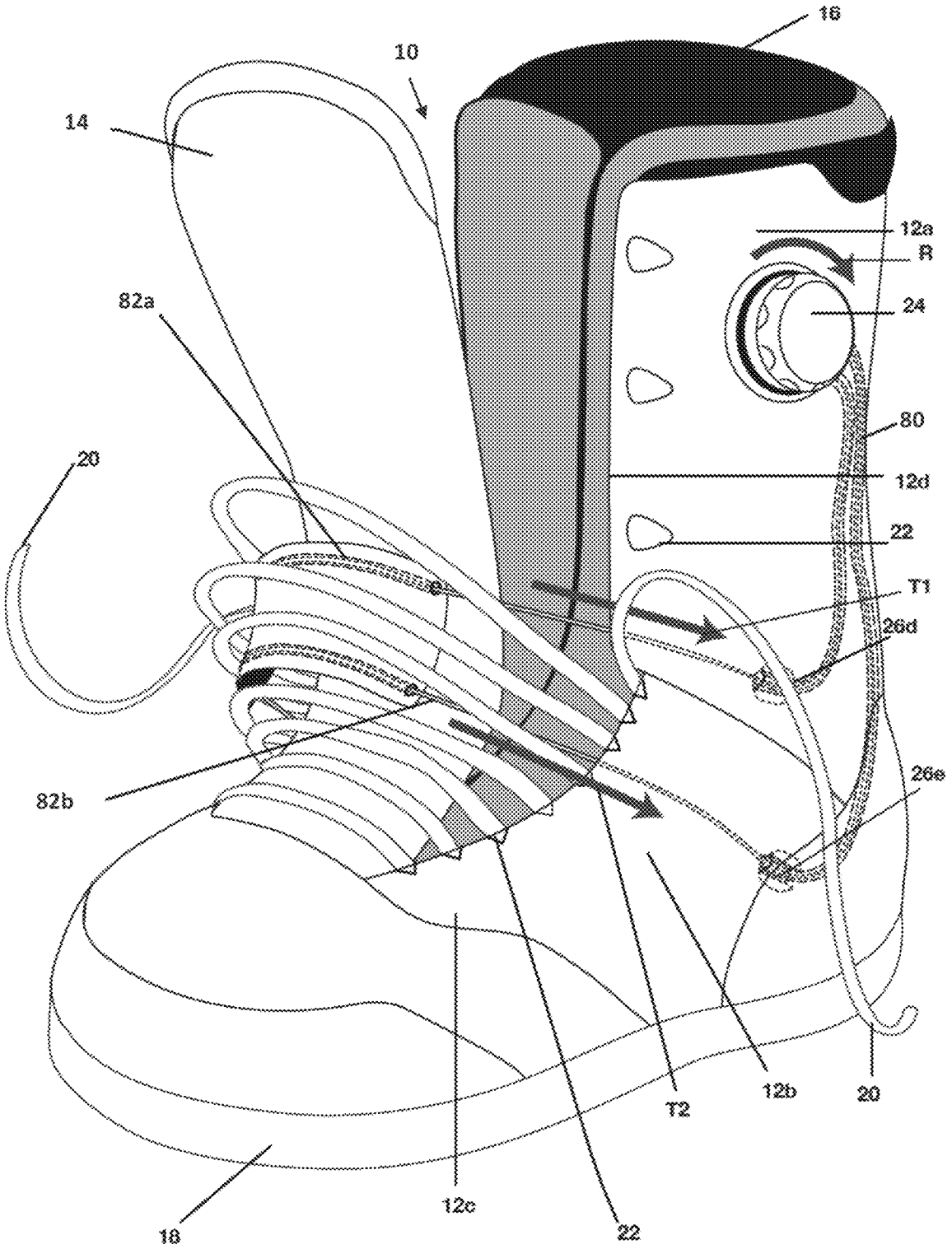

Representative embodiments incorporating one or more aspects of the inventive subject matter are shown in FIGS. 1 through 9, wherein the same or generally similar features share common reference numerals.

In broad terms, according to the inventive subject matter, an item of footwear is configured with a foot retraction system for closing around the foot and retracting a portion of the footwear against a user's foot into the footbed and heel area of the item. In certain respects, disclosed innovations generally pertain to systems for tensioning a boot to the foot of a user so that the foot is retracted as so. The inventive subject matter is particularly useful with snowboarding boots. It can also be used with a variety of other kinds of boots, including ski boots, skate boots, hiking boots, and any other kind of footwear where it is desirable to engage an item footwear around the foot and keep the foot from lifting or sliding in the item of footwear.

For illustrative purposes, a snowboard boot will be used as a representative boot in which the inventive subject matter may be embodied. From the following discussion, persons skilled in the art will understand how the inventive subject matter may be embodied in other forms of boots and footwear. A snowboard boot 10 typically has an outer shell 12. The shell is typically a semi-rigid structure made of an assembly of materials, such as one or more of sheets or layers of natural or synthetic leathers, woven or non-woven textiles, and plastics and rubbers. Some or all of the shell may be made of molded plastics or rubbers. The boot may also include a tongue 14 or a region corresponding to a tongue, in the case of a tongueless boot, such as a rear entry boot. The tongue may be part of the shell or it may be coupled to another structure in the boot, e.g., the sole or an inner liner.

The boot may have an inner liner 16, which is usually a removable bootie but it can also be built into the shell 12. A footbed for receiving the bottom of the user's foot is part of the boot, and may be formed in the liner material or it may be a separate structure. The boot also includes a heel cup for wrapping around and receiving the heel of a user. It is typically formed in the liner. In the representative embodiment shown in the Figures, opposing edges of shell 12 are spaced apart and in-filled by tongue 14.

The outer shell includes an upper portion 12*a* that extends upward from the instep, over the ankle, and around a lower leg portion of a user. The shell also includes a proximal foot enclosure portion 12*b*, enclosing the general areas of the instep and heel and a distal portion 12*c* for enclosing the top and sides of the midfoot and forefoot. The boot includes a sole 18 that connects to shell 12 and covers the bottom of the user's foot.

The outer shell 12 in a snowboard boot is made up of relatively stiff and rugged materials, such as leathers and semi-rigid or rigid plastics, rubbers, or other such materials. The shell may include an inner liner that is typically made up of a thickened set of materials that provide cushioning, comfort, and insulation to a user's foot. For example, the liner may be made of a core of foamed polyurethane (PU) or ethyl vinyl acetate (EVA) materials with outer and inner linings of a textile or fabric. The inner liner 16 may also be separate removable component such as a bootie. The tongue or tongue region 14 of the boot may be constructed in way that is similar to that of the liner.

The sole may be made of rubber, EVA, PU and other known midsole and outsole materials alone or in combination. The shell and soles may be lasted together using any known or developed techniques, including board lasting.

In the embodiment shown in the Figures, the upper portion of the shell 12 has spaced-apart, vertically-oriented edges 12*d* and 12*e*. A tongue 14 may be disposed on the boot in the spacing between the edges.

Boot 10 has a flex zone 13 that generally corresponds to the ankle joint of the intended wearer. The ankle joint is a hinging joint between the foot and the leg. The uppermost bone of the foot, called the talus (ankle-bone), is disposed between the two bony protuberances formed by the lower ends of the tibia (shin bone) and the fibula. By tensioning the boot over the ankle's hinge joint, the element can cause the foot to be secured over the sole of the boot, allowing for precise and controlled flexation and transmission of power to a snowboard.

Boot 10 may include a closure system that provides for converging of the opposing edges 12*d* and 12*e* at least partially over and against the tongue, thereby urging the shell and tongue securely around the leg of a user. One common type of closure system is a cable-based system. As used herein, a "cable" is a broad term that means any known pliant, flexible, thin, elongate, tensionable structure that allows for routing along a set of closure elements arranged on a pair of opposing edges that are to be drawn together. Accordingly, a suitable cable 20 may include any form of shoe or boot lace, cables of bundled metal fibers or of non-metals, strings, cords, chains, leather strips, etc. Closure elements 22 in a cable-based closure or tensioning system may be any combination of loops, hooks, eyelets, gilleys, and other such structures that can receive a cable. Mechanical closure systems are also well known. In a mechanical closure system, the closure elements may be buckles, straps (e.g., belt style or Velcro style), clamps, etc.

Figure 3:
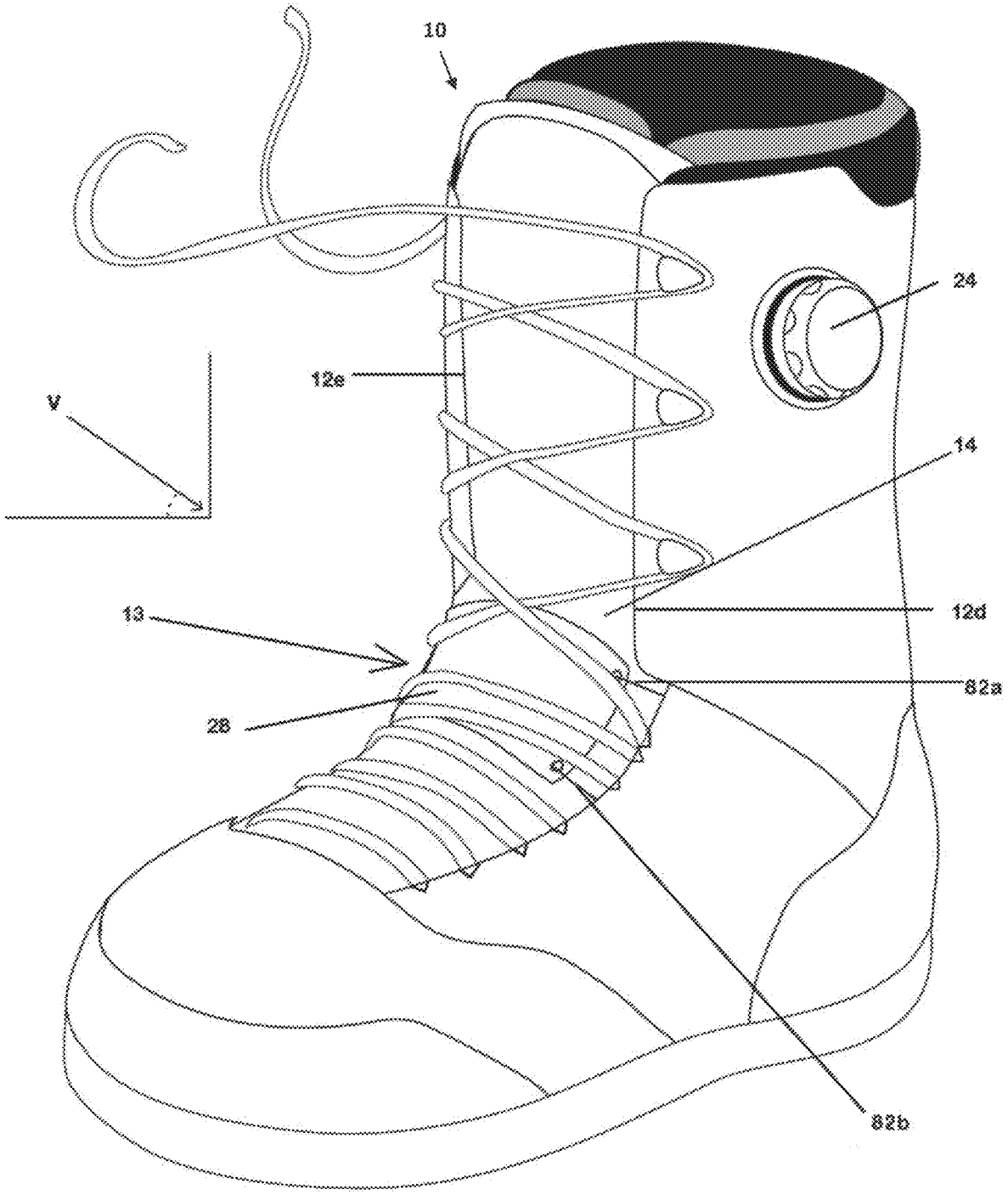

In the representative embodiment of the Figures, sets of closure elements 22, of the same or different forms, are arranged along edges 12*d* and 12*e* that run from the front of the lower leg portion of the boot, downwardly and over the top of the foot, to the toe region of the boot. Closure systems 22 for snowboard boots and various other kinds of boots are generally centered over the front of the lower leg and the top of the foot. They typically do not extend substantially beyond such centralized areas to the side portions of the boot. To illustrate the operation of a closure system, FIG. 1 shows boot 10 with edges 12*d* and 12*e* spaced apart; FIG. 3 shows them converged together and over tongue 14.

Cable-based systems deployed from a retractable reel, e.g., a reel in tensioning mechanism 24 in FIGS. 1 & 3, are another form of closure system that may be used to draw together opposing edges 12*d* and 12*e*. Examples of such systems are found in numerous US and foreign patents, including in the examples listed below, as well as from commercial vendors, such as Boa Technology, Colorado, USA.

The inner liner 16 may include spaced apart edges and a tongue, similar to edges 12*d*, 12*e* and tongue 14, and any form of closure system described above.

The inventive subject matter contemplates novel tensioning systems that act on one or more cables 120 along a tension path to retract the foot against parts of the boot to better seat the foot in the boot. A tensioning mechanism 24 is coupled to the cable(s) to adjustably control tension. Such a foot-retraction system may be used in addition to or instead of a conventional closure system, such as those described above. In the embodiment shown, tensioning mechanism 24 is a reel-based tensioning mechanism. The cables may be of the same nature as described above for the conventional closure systems.

Figure 2:
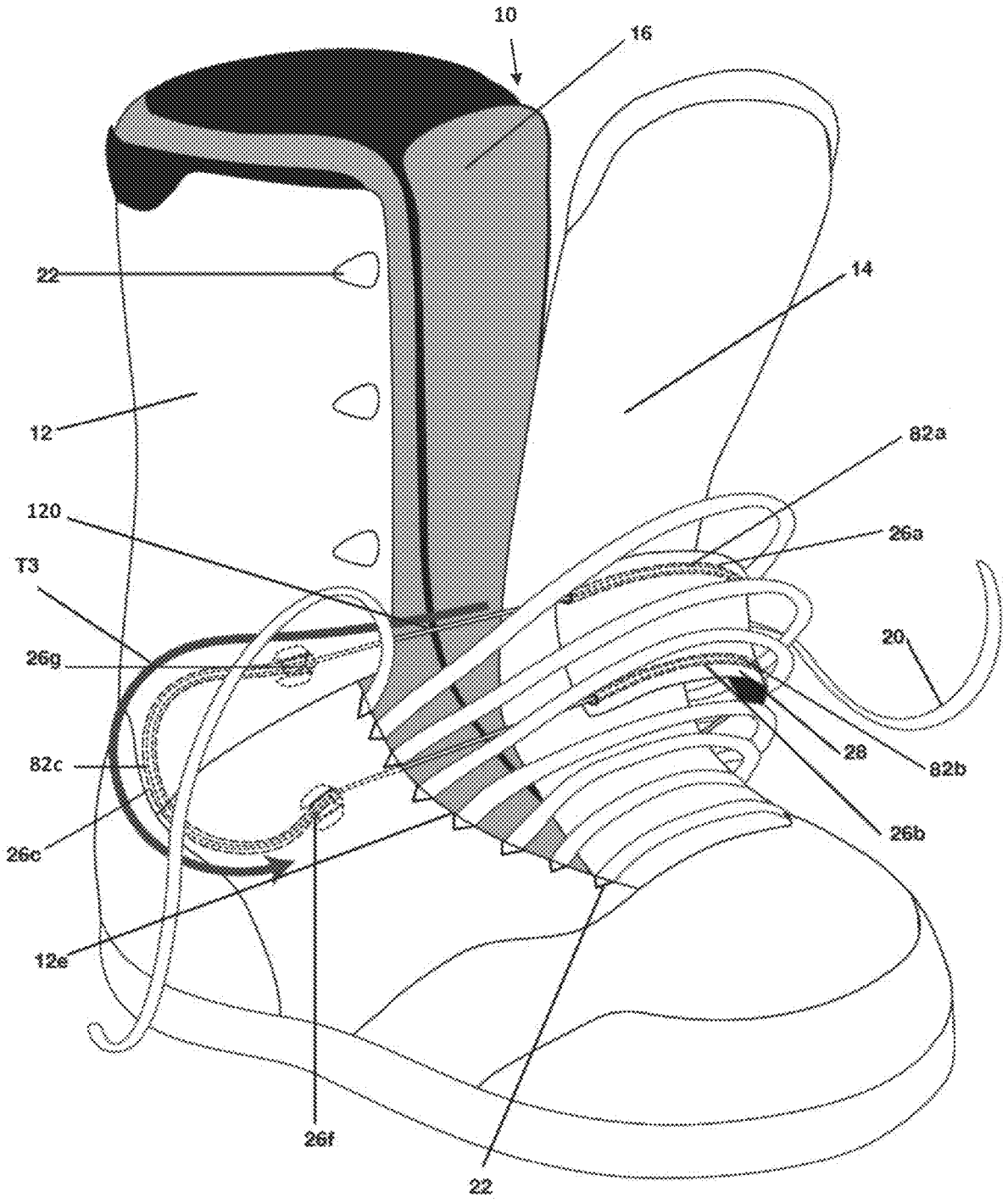

Arrows T1, T2 and T3 in FIGS. 1-2 indicate the direction of force along the tension path when the knob on tensioning mechanism 24 is rotated in direction R, causing tensioning of cable 120, whose ends are disposed on a spooling reel coupled to the knob. In certain embodiments, such as the one shown, one or more cables, such as cable 120, may be routed along a tension path from one side of the boot, across the tongue or tongue region 14, to an opposite side of the boot, to create a tension path that tensions the instep, simultaneously causing the bottom side of the user's foot to retract against the footbed and heel areas of the boot. In certain embodiments, this occurs because at least the tongue 14 is urged rearwardly and downwardly by the tensioned elements in the tension system.

In contrast to conventional closure systems arranged on opposing edges, such as edges 12*d* and 12*e*, in the inventive subject matter, the tension path extends over the instep area laterally and medially and substantially away from the edges. It continues beyond the edges and wrapping around the sides of the foot or lower leg. For example, the extension may be at least 2.5 cm from the edges and in some cases 5.0 cm, 7.5, 10.0 cm, or more.

More particularly, in the embodiment shown, a tension path spans the instep or closely adjacent area above and/or below the instep. (Hereinafter the instep and closely adjacent areas may be referred to as the "instep area"). The tension path extends generally laterally and medially from the opposing edges 12*d* and 12*e* to the sides of the boot and at a downward angle. It continues at least to points on the lateral and medial sides of the boot that approximately align with the ankle area of the boot.

While the Figures show a tension path crossing over the instep area of a boot, the inventive subject matter also contemplates that a tension path may be constructed so that it passes transversely over longitudinal foot or leg positions ranging from about the metatarsal heads to the front lower leg area. In such cases, the tension path extends to positions on the lateral and/or medial sides of the foot that are at least at or about the ankle. One or both terminal ends of such a tension path on a boot may be vertically above, below or over the height of the ankle portion. In certain embodiments, the tension path may extend longitudinally on the foot to a position that is behind the ankle and to the side areas or rear areas of the heel.

The cable or cables associated with a tension path may be slidably disposed along the path, and therefore tension the shell and/or tongue against the top and/or sides of the user's foot. This tension will tend to cause the foot to retract into the footbed and/or heel areas of the boot. In the embodiment shown, the tension path is arranged to provide for a force vector that tensions the boot downwardly and rearwardly against top and sides of the user's foot. The result is that the user's foot is pulled down against the footbed and pulled rearwardly against the heel area, i.e., it is retracted into the areas by virtue of the boot tongue 14 pressing on the top or side surfaces of the foot. In the various tension paths contemplated herein providing a downward and rearward force vector, the tension path may include a portion that is disposed at an angle of about 20 degrees to about 70 degrees from horizontal, providing a direction to the corresponding force vector. This downward and rearward vector V is generally indicated in FIG. 3.

The cable or cables along such a tension path may interact with the tongue and shell in any one or more ways to tensionably engage those parts. For example, one or more sections of one or more cables may be routed over the surfaces of the parts, such as the tongue and shell, and/or the cable or cable sections may be routed in channels or guides 26 through the parts. Channels or guides, such as 26*a*, 26*b*, and 26*c*, may be formed in the layer or layers of materials that make up the shell or liner. Guides could be constructed or formed in or on such layers in any number of ways, e.g., leather, synthetic leather, an injected/molded piece, or no guide at all, e.g., just a section of cable over a surface.

In addition to guides or channels that are integrated into a boot part, guides or channels, such as 26*d*, 26*e*, 26*f* and 26*g* may be defined by discrete elements that are attached to a boot part and define a segment of a tension path. Such elements may include tubes, collars, loops, rings, hooks, etc., that are arranged along a section of a tension path. Discrete elements may be most suitable where the tension path needs reinforcement, such as at turns in the path or at anchor points. In the example shown, the tension path includes a section that crosses transversely over the outer surface of the tongue 14. Then it extends below the outer surface of outer shell 12, either within the shell layer(s) or on inner surfaces of the shell. Any combination of routing—over surfaces, between surfaces, or on inside surfaces—is contemplated.

From the foregoing, it will be understood that guide elements, such as loops, rings, sleeves, tubes, etc., disposed on exterior or interior surfaces, or between surfaces, may be used to define the direction of a segment of a tension path or to facilitate a change in direction of a tension path, while maintaining tensionable engagement with boot parts along a path. Guides may be affixed to the surface of the parts or they may be free-floating or repositionable over the parts. A free-floating or repositionable element advantageously allows a user to selectively define a tension path and tune the fit of the boot. A repositionable guide also may be used in the same or different tension path to allow for clearance of objects through the path. For example, a guide may have a portion that snaps or screws into the boot and which can easily be removed by a user's hand so that the user can pull cables out of the opening into which a foot is placed when the boot is taken on or off.

The Figures show a guide that is integrated with a pressure distribution element 28, e.g., a pad, band, or cuff. The guide is disposed over the top of tongue 14. The guide includes channels through which cables are slideably routed. The pressure distribution pad has a substantially broader surface than the associated cables and thereby distributes the pressure of the cables over a broader surface area. For example, the pressure distribution element could be at least 1.0 cm wide and at least 2.0 cm long, in comparison to a cable of not more than a few millimeters in diameter, typically 0.5 mm to about 8.0 mm. The pressure distribution element 28 shown is not affixed to the tongue or other part of the boot. Rather it is free-floating and vertically and/or laterally repositionable by the user in a desired location over the tongue. It may also self-position according to shape the boot takes with a given foot within it.

In other embodiments, a separate pressure element is not necessary and the tongue itself may serve that role. The tongue 14 may have external or internal guides or channels for routing of one or more cables. Guides or channel may be similarly arranged most anywhere else on or in the outer shell parts or other boot parts for routing of the cables.

The tension path may also continue beyond the paths indicated above. For example, in the Figures, the tension path on the lateral side angles or curves upwardly and extends along the side of the boot towards the top of the lateral side of the boot to a tensioning mechanism 24 (discussed in more detail below) for tensioning the cables along the tension path. Such a routing allows a user to more easily reach and manipulate the tensioning mechanism to adjustably increase or decrease tension.

One or more cables may be disposed along a given tension path. There may also be multiple tension paths, each with one or more cables. The tension on a cable in the tension path may be applied in a number of ways. In each case, the ends of the cable have anchor points that anchor the cable or a segment of the cable in tension. The anchor points can be a fixed or adjustable structure of mechanism. At a fixed anchor point, the end of a cable or segment of a cable is fixed to the point. For example, it is stitched, glued, tied, and/or mechanically captured, to the point. In an adjustable anchor point, the end or the cable or segment of the cable may be repositioned relative to the anchor point and then fixedly captured by it. For example, there are various known spring-based clamping mechanisms for engaging a clamping element against a cable. The spring force against the clamping device fixes the cable in clamping mechanism. Depressing the spring elements disengages the clamping element and allows a user to adjust cord or cable tension.

Devices that can provide mechanical advantage or leverage when associated with a cable include shackles, blocks, pulleys, sheaves, and geared systems with reduction gears. Rotating elements as tensioning mechanisms can also provide leverage based on providing relatively large diameter wheels or levers on a pivot point to which a cable may be connected. For example, a wheel of tensioning mechanism may be configured with a diameter that enhances leverage of a cable spool (not shown) to which it is rotatably coupled.

In the embodiment shown in the Figures, a tension path has at one end a tensioning mechanism that are operationally clear and independent of the closure system on the edges 12*d* and 12*e*. The tension path shown is also routed under the closure system (i.e., cable 20 and closure elements 22) so that the cables associated with the tension path and those for the closure system do not impede one another. In the embodiment shown, a single cable 80 is disposed on the tension path. Each end of the cable is connected to a rotatable tensioning mechanism so that a loop is formed. The loop has generally parallel sections 82*a*, 82*b* that extend over the instep area. The loop has a closed end 82*c* opposite the rotatable tensioning mechanism 24. The loop end 82*c* is coupled to an anchor point 26*c* disposed on the side of the boot that is opposite the side of the tensioning mechanism. In this example, the anchor point is a U-shaped channel 26*c* or guide through which the end 82*c* of the loop is routed. It blocks the loop end from pulling forward, allowing simultaneous tensioning of the parallel segments when the free ends are simultaneously tensioned by a tensioning mechanism. If there is not simultaneous tensioning, the cable will slide in the channel shown in the direction of the tensioning. This may be avoided by fixedly attaching the loop end of the strand to an anchor point instead of using a U-shaped channel.

In the embodiment shown in the Figures, the anchor point 26*c* is on the medial side of the boot below and aligned with or behind the ankle area of the boot. Parallel sections 82*a*, 82*b* route respectively through guides 26*a* and 26*b* across the instep area of the boot to turning elements 26*d* and 26*e*, e.g., collars or sleeves, that redirect the cable sections upwardly to their anchor points on a reel in the tensioning mechanism 24. By connecting the ends of the cable sections to the reel, the sections are windable on the reel and simultaneously tensionable. The reel is contained in a housing or on base, and not shown in the Figures. The reel rotates on an axle in housing or base portion of the tensioning mechanism. The reel is rotatably coupled to a knob accessible by a user and mounted on the external side of the housing or on the base. The tensioning mechanism may include a ratchet mechanism that allows the wheel and reel to be turned by a user to apply tension from the tensioning mechanism across the cable to the medial side anchor element 26*c*. When tension is applied, the part of the boot that section 26*c* is integrated is urged toward the opposite part to which the tensioning mechanism is mounted.

Examples of suitable reel-based tensioning mechanisms are found in the following patents: U.S. Pat. No. 7,082,701, in the name of Vans, Inc., U.S. Pat. Nos. 4,748,726, and 7,512,521, which are hereby incorporated by reference in their entireties for all purposes. The '521 patent discloses reel system for tensioning a cable on a tension path in an item of footwear. The '521 patent discloses that the tensioning mechanism may include a wheel that pops out of the housing or base unit affixed to the outer shell of an item of footwear. In the out position, a ratchet in disengaged and the cable tension can be released.

Tensioning mechanisms include not only reel-based system for retracting cables, but various other tensioning mechanisms, including spring-based clamping systems, turnbuckle systems, and even simple posts, hooks, or other such receivers mountable on a boot or other item of footwear and to which cables can be tied off.

While the foregoing system is described in terms of a single cable in a loop, it will be understood by persons skilled in the art that the single loop could be replaced by two or more individual cables, each with one end anchored to the same or different tensioning mechanisms on one side of the boot and the other end anchored to an anchor point on the other side of the boot. For example, the embodiment shown in the picture could be modified by in essence cutting the end of the loop to provide two separate cables emanating from one or more tensioning mechanisms on the opposite side of the instep, in this case the lateral side). Each free end on the medial side would be anchored to the same or different anchor points on the medial side. A tension path using guides could also be configured to allow for the tensioning mechanism and anchor point to be on the same side of the boot with the tension path crossing to opposite sides of the boot.

A leverage effect may be provided along any tension path by a having a tensioned cable pass over the instep using turning points over which the tensioned cable slides or pivots. For example, a modification to the embodiment shown could be take one cable end of the reel of tensioning mechanism and anchor it anywhere on the same side of the boot as the tensioning mechanism (in this case the lateral side). The cable would be slidably disposed over the anchor point at the medial side, which would actually become a turning point. The tensioning mechanism would wind the cable at one end and apply tension across the whole tension path, which would be disposed between the two anchor points on the lateral side. The cable could have a tension path that crosses the instep multiple times using multiple turning points on opposite sides of the instep to provide multiples of leverage. A turning element can be any kind of pivot device that allows for rolling engagement. For example, the pivot device could a low friction D-ring, O-ring, a sleeve, collar, a block, a sheave; roller, pulley wheels, etc.

Figure 4:
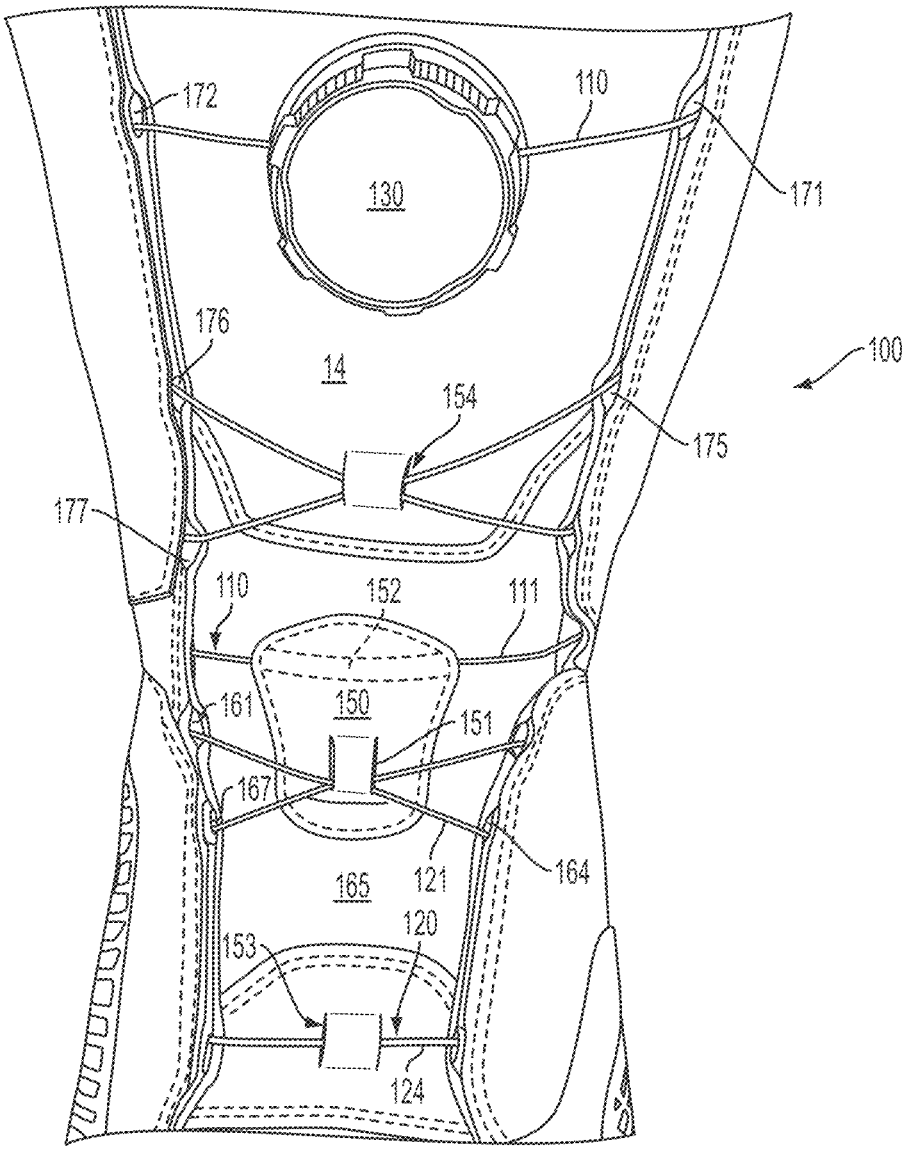
Figure 5A:
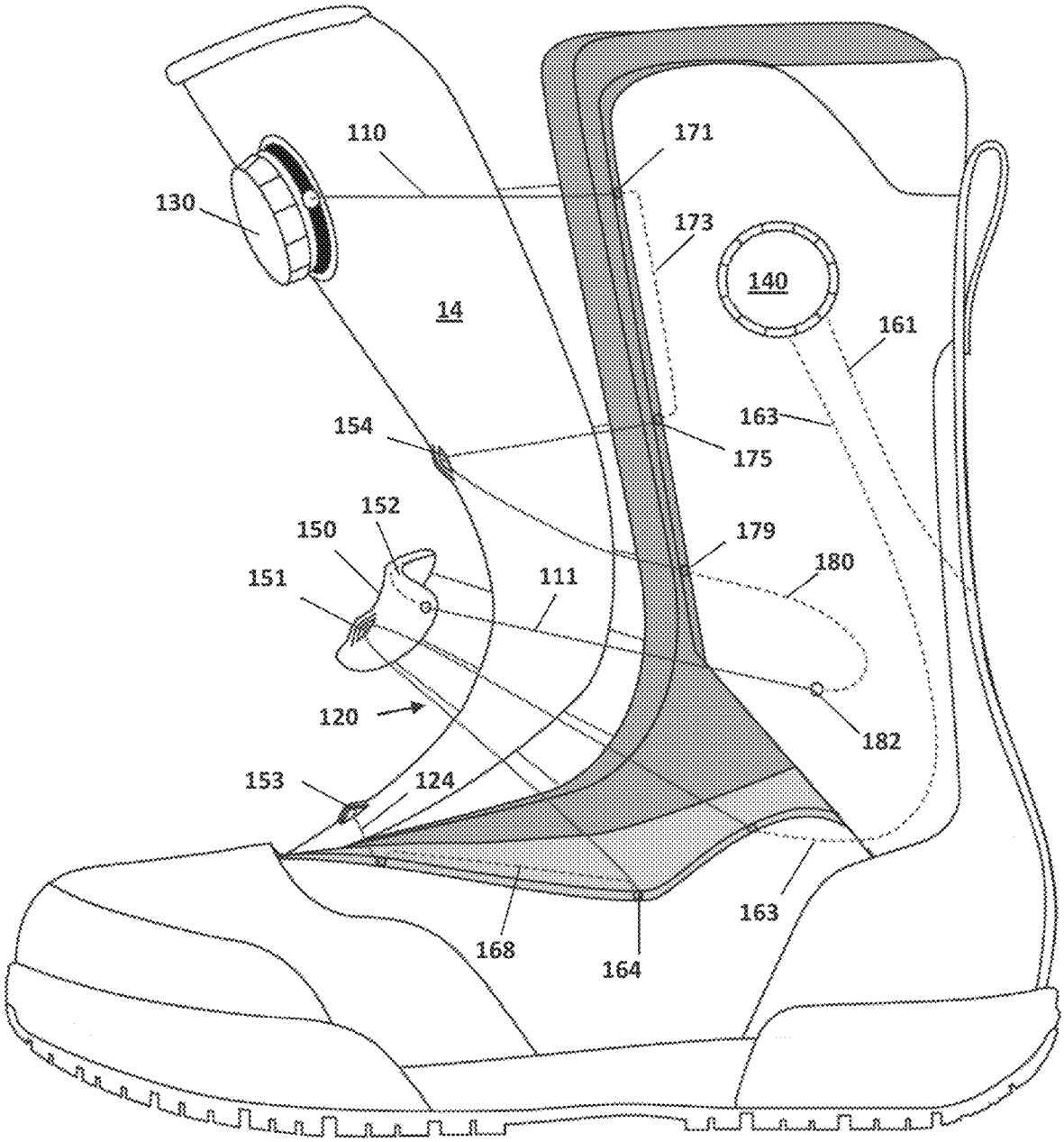
FIG. 5A shows a lateral, side-elevation view of the boot and tensioning system shown in FIG. 4 in an untensioned condition.
Figure 5B:
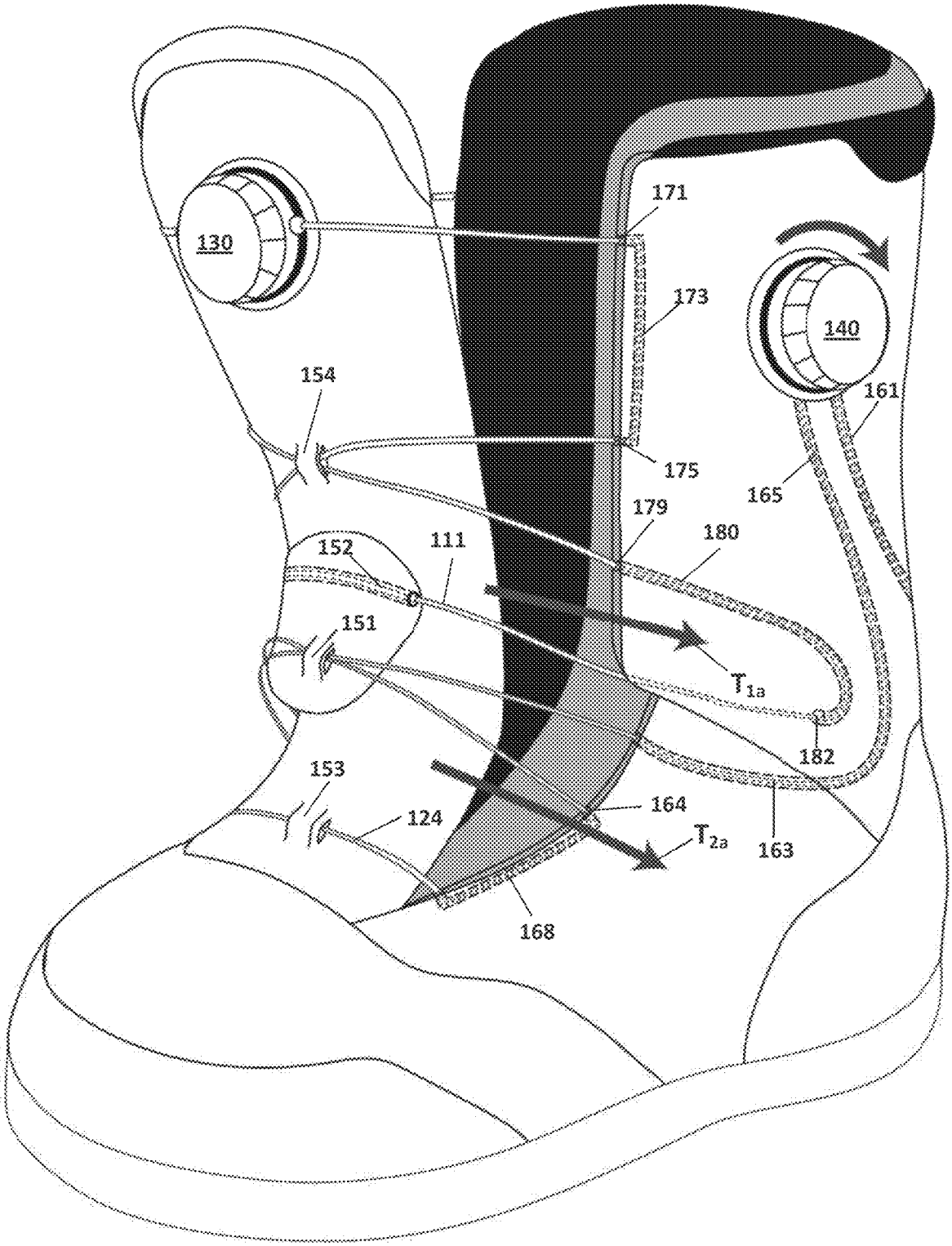
FIG. 5B shows a lateral perspective view of the boot and tensioning system shown in FIGS. 4 and 5A.
Figure 6:
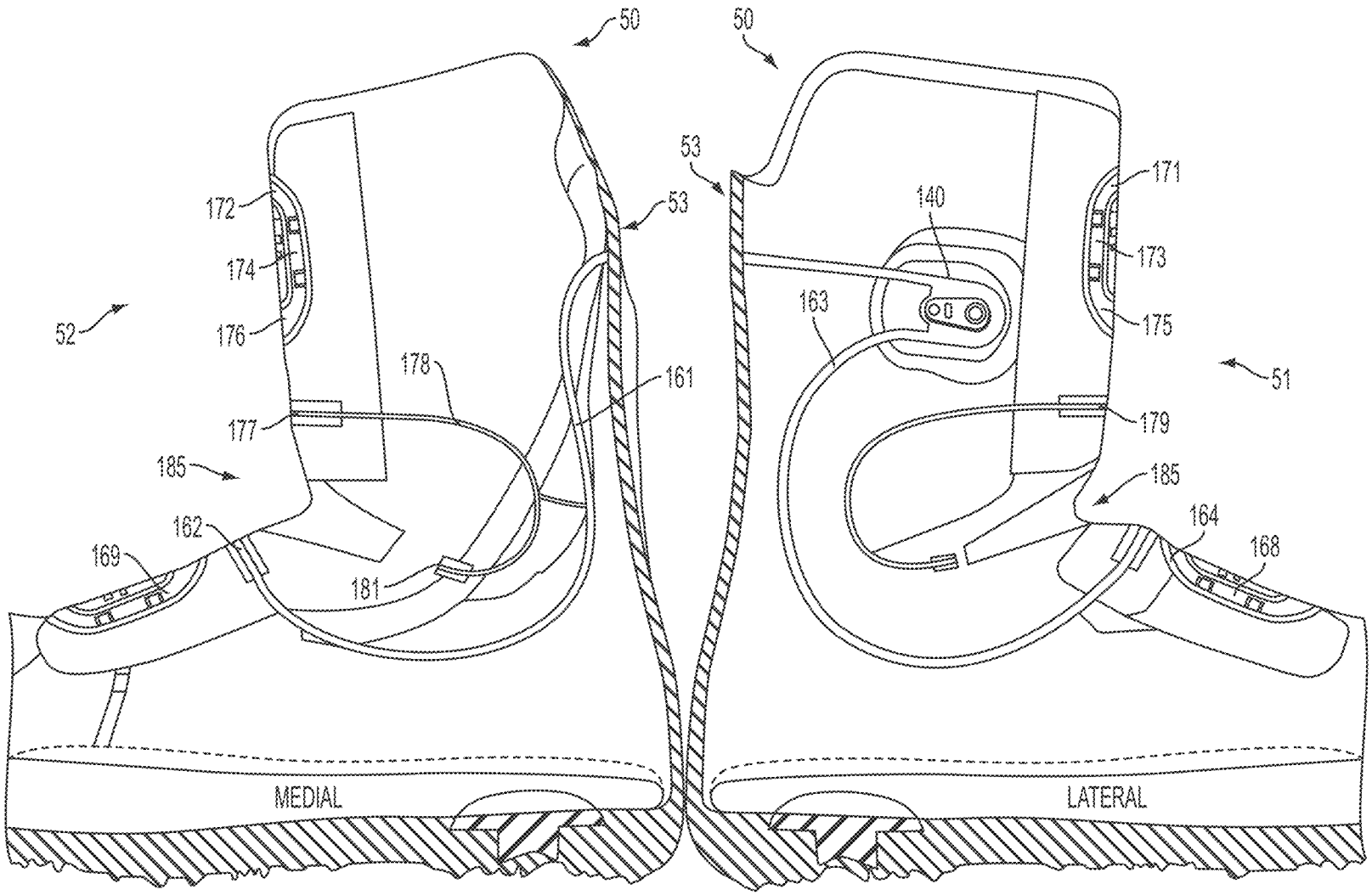
Figure 7:
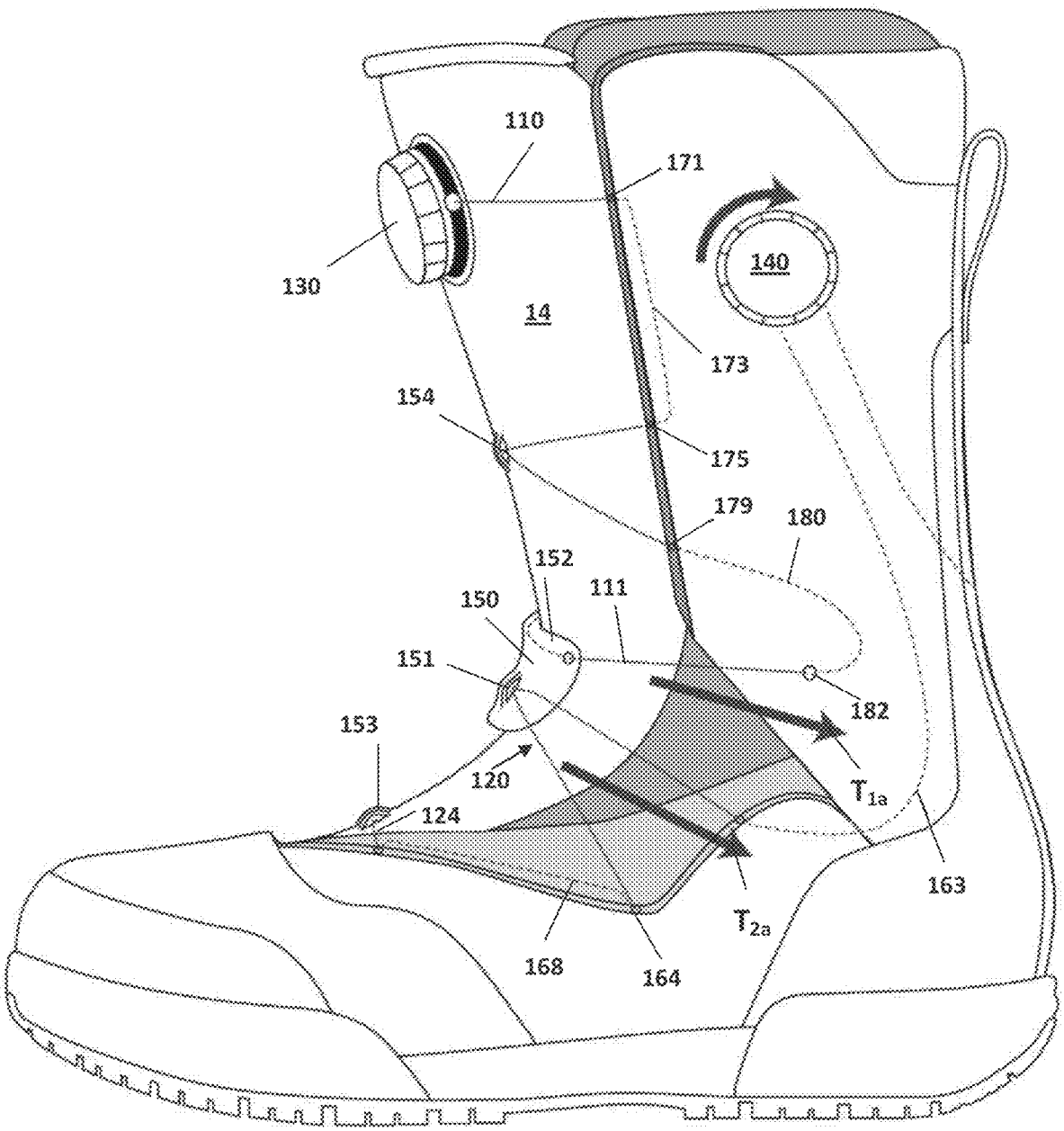
Figure 8:
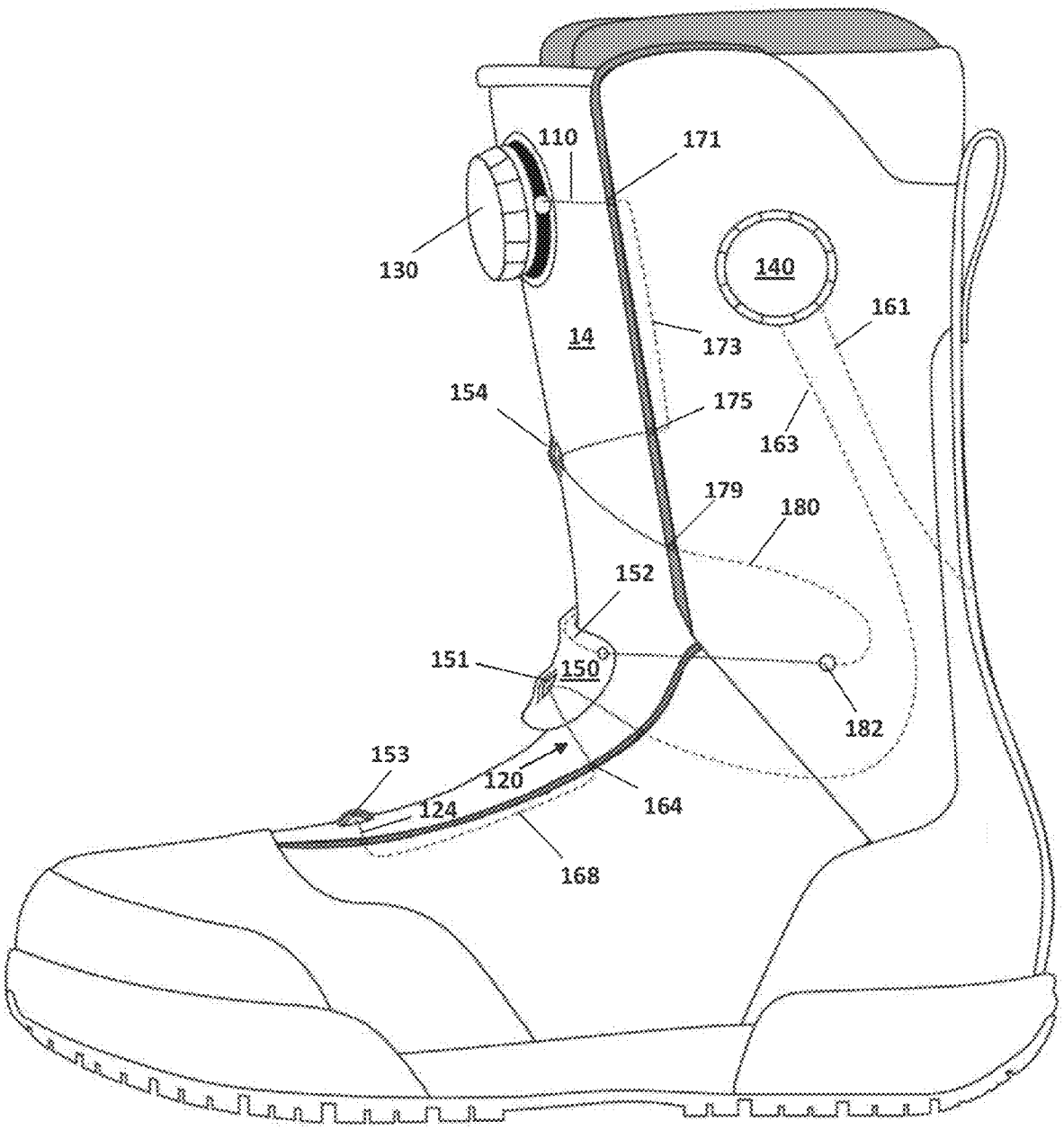
Figure 9:
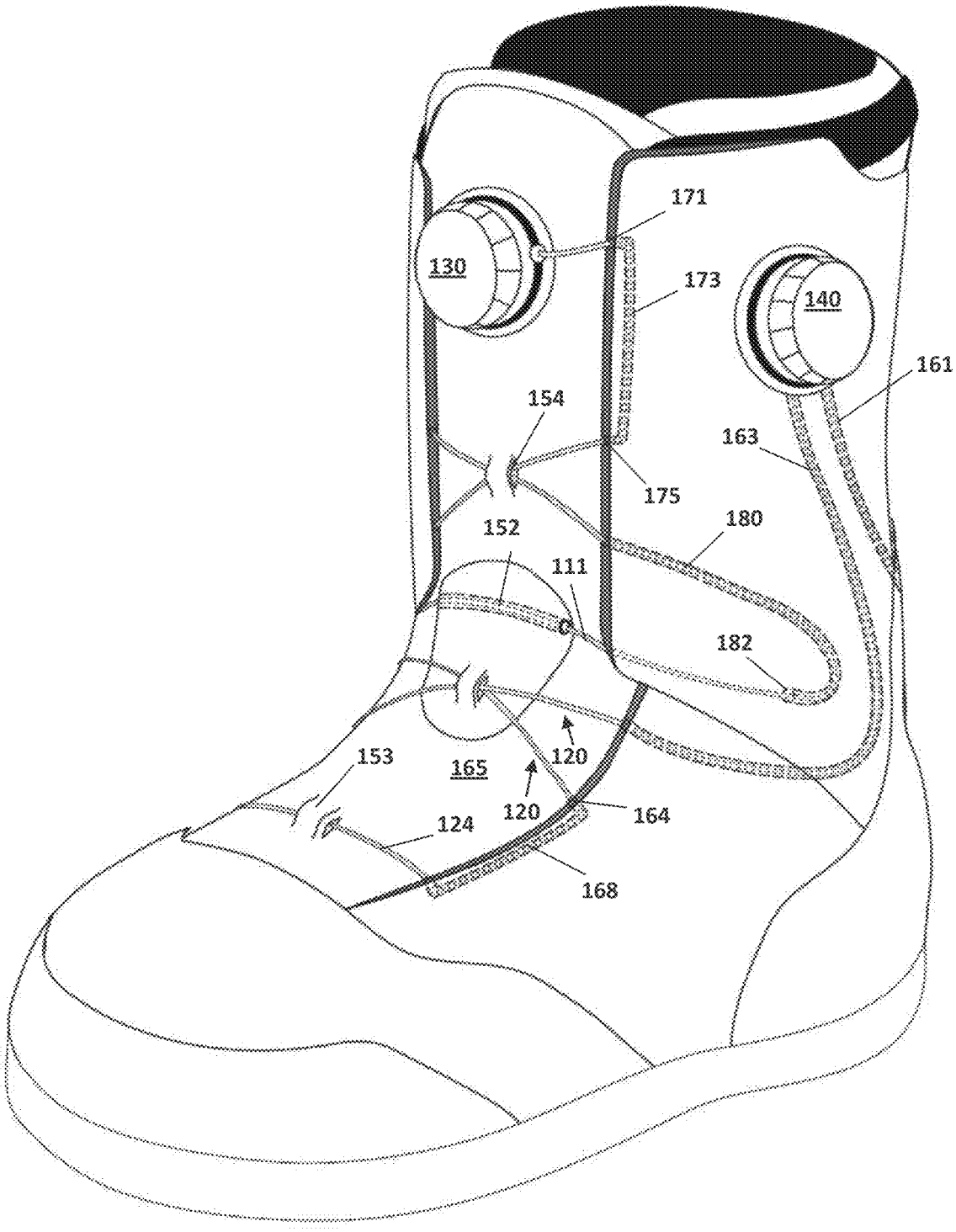

FIGS. 4 through 9 show another possible arrangement of a tensioning system, as described above. FIGS. 4-5B and 7-9 show external features of the arrangement, and FIG. 6 shows a bisected shell revealing internal aspects of the arrangement.

The tensioning system 100 shown in FIGS. 4 through 9 includes an upper cable 110 and a lower cable 120 operatively associated with respective upper and lower tensioners 130, 140 to form respective upper and lower cable loops in a manner described above. For example, each of the upper cable 110 and the lower cable 120 defines opposed open ends anchored to a respective tensioner 130, 140, forming a respective loop.

Such an arrangement permits the upper cable 110 and the lower cable 120 to be selectively tensioned independently of each other. Additionally, a tensioning system 100 arranged as shown in FIGS. 4 through 9 can draw opposed edges of the shell together with sufficient closure force as not to need or use a separate closure system (e.g., laces, as shown in FIGS. 1 through 3). Stated differently, a tensioning system 100 arranged as shown in FIGS. 4 through 9 can constitute, in some embodiments, a foot retraction system.

The tensioning system 100 arrangement shown in FIGS. 4 through 9 can be used in connection with a boot having a tongue 14 or a boot having a tongue-like element, just as with tensioning systems shown in FIGS. 1 through 3. In FIGS. 4 through 9, the tensioning system 100 includes a floating element 150 positioned outwardly of the tongue 14 relative to a user's leg.

The floating element 150 couples the upper loop formed by the upper cable 110 and the lower loop formed by the lower cable 120 to each other. In particular, as shown in FIG. 4, an upper segment 121 of the lower loop passes through a lower channel 151 (e.g., a perforation) defined by the floating element 150, and a lower segment 111 of the upper loop passes through an upper channel 152 of the floating element 150. As with tensioning systems described in detail above, a channel permits a sliding engagement between a cable, or a segment thereof, and an adjacent, overlying structural component (e.g., an upper of the boot, the floating element).

With an engagement between the floating element 150 and the upper and the lower cables 110, 120 as just described, a selected tension applied to the upper cable 110 and a selected tension applied to the lower cable 120 can urge the floating element 150 inwardly of the boot (e.g., toward a user's instep) in a selected manner. As but one example, with such a configuration, the floating element 150 in conjunction with the independently tensionable upper and lower cables 110, 120 can, as indicated in FIG. 5B, apply a selected force vector $T_{1a}$, $T_{2a}$(e.g., a selected force magnitude and a selected force direction) to a wearer's instep, providing a user-selectable degree of comfort, together with a user-selectable degree of downward and rearward seating of the wearer's foot in the foot bed and heel in the heel cup.

For convenience, routing of the upper cable 110 and routing of the lower cable 120 are now described in relation to FIGS. 4 through 9. Nonetheless, other arrangements of cables and tensioners are possible and contemplated to be within the level of ordinary skill following a review of this disclosure.

As noted above, the lower cable 120 defines opposed ends captured by a corresponding lower tensioner 140 (FIGS. 5A-9). With the arrangement depicted in FIGS. 4 through 9, the lower tensioner 140 is positioned outwardly of the lateral side of the upper portion of the lower cable 120. A position of the lower tensioner 140 can be selected elsewhere for user convenience and comfort without departing from the scope and spirit of this disclosure.

The opposed ends of the lower cable can be affixed to the lower tensioner 140 such that portions of the lower cable 140 proximate to the lower tensioner 140 can be wound about a reel of the tensioner in a manner as described above.

With a routing as shown in FIGS. 5A-9, a first upper portion of the lower cable 120 can pass into a conduit 161 (or a channel), extending rearwardly of the boot from the lower tensioner 120 on the lateral side 51 of the boot 50 and around a rear portion 53 of the boot 50 in a region adjacent to or slightly above a wearer's Achilles tendon, and to an upper rear portion of the medial side 52 of the boot. The first upper portion of the lower cable can be routed downwardly along the rear portion 53 (e.g., a proximal portion) of the medial side 52 of the boot (e.g., along a portion of the boot overlying a region between the wearer's Achilles tendon and a medial protuberance of the ankle) to a lower rear portion of the medial side 52 of the boot. The first portion of the lower cable can be routed distally from the lower rear portion 53 of the medial side 52 of the boot 50 to a position 162 of the medial edge of the shell 12 overlying a lower portion of the wearer's instep, indicated by the position of the upper anchor channel 161 (sometimes referred to as an anchor point) for the lower cable 120 in FIG. 6.

With a routing as shown in FIG. 6, a second upper portion of the lower cable 120 can pass into a conduit 163 extending rearwardly of the boot 50 from the lower tensioner 140 and downwardly along the rear portion (e.g. a proximal portion) of the lateral side 51 of the boot 50 (e.g., along a portion of the boot overlying a region between the wearer's Achilles tendon and a lateral protuberance of the ankle) to a lower rear portion 53 of the lateral side 51 of the boot 50. The second portion of the lower cable 120 can be routed distally from the lower rear portion of the lateral side of the boot to a position 164 of the lateral edge of the shell opposite the position 162 on the medial edge of the shell to which the first portion of the lower cable is routed.

As shown in FIGS. 4-9, the first upper portion of the lower cable 120 can span the gap 165 between the medial and the lateral edges of the shell, passing from an upper anchor channel 161 positioned adjacent the medial edge, through the lower channel 151 defined by the floating element 150, and into an upper aperture 164 of a lower anchor channel 168 positioned adjacent the lateral edge of the shell 12. As also shown in FIG. 4, the second portion of the lower cable 120 can span the gap 165 between the lateral and the medial edges of the shell, passing from an upper anchor channel 163 positioned adjacent the lateral edge, through the lower channel 151 defined by the floating element 150, and into an upper aperture 167 of a lower anchor channel 169 positioned adjacent the medial edge of the shell.

An intermediate segment 124 of the lower cable, sometimes also referred to as a lower segment, is continuous with and extends between the first upper portion and the second upper portion of the lower cable. For ease of reference, the intermediate segment 124 can be considered as extending between opposed portions of the lower cable 120 positioned adjacent the upper aperture 164 of the lower anchor channel 168 positioned adjacent the lateral edge of the shell and the upper aperture 167 of the lower anchor channel 169 positioned adjacent the medial edge of the shell. As shown in FIG. 4, a portion of the lower segment spans a distal portion of the gap 165 between the lateral edge and the medial edge of the shell, passing through a lower tongue channel 153.

As noted above, when a selected tension is applied to the lower cable 120, distal portions of the opposed medial and lateral edges of the shell are urged together by forces applied to the channels 161, 163, 168, 169 by the cable 120, and a lower portion (e.g., a distal portion) of the floating element 150 is drawn toward the user's instep in a direction and with a force magnitude (e.g., force vector Tea) at least partially corresponding to a selected tension and relative positions of the user's instep, the lateral edge, and the medial edge (e.g., since the apertures of the channels 161, 163, 168, 169 are positioned adjacent the edges).

Arrangements of the upper cable 110 will now be described. In FIG. 4, an upper tensioner 130 is positioned on the tongue 12, and the upper cable 110 extends laterally and medially outwardly of the upper tensioner 130 into upper apertures 171, 172 of respective lateral and medial upper anchor channels 173, 174.

The opposed ends of the upper cable can be affixed to the upper tensioner 130 such that portions of the upper cable 110 proximate to the upper tensioner 130 can be wound about a reel of the tensioner in a manner as described above. The opposed portions of the upper cable 110 extend through the respective upper anchor channels 173, 174 and outwardly of lower apertures 175, 176 defined by the respective upper anchor channels 173, 174.

The portion of the upper segment of the upper cable extending from the lateral-side aperture 175 spans the gap 165 between the lateral and the medial edges, passing through an upper tongue channel 154 and into an aperture 177 defined by a lower anchor channel 178 for the upper cable, positioned on the medial side 52 of the shell. The portion of the upper segment of the upper cable 110 extending from the medial side aperture 176 spans the gap 165 between the medial and the lateral edges, also passing through the upper tongue channel 154 and into an aperture 179 defined by a lower anchor channel 180 for the upper cable, positioned on the lateral side 51 of the shell.

As shown in FIG. 6, the respective medial and lateral lower anchor channels 178, 180 for the upper cable 110 extend rearwardly from the edges of the shell to a position generally rearward of a user's ankle protuberances, downward around the ankle protuberances and forward to a position 181, 182 generally below and slightly forward of the ankle protuberances. In some embodiments, the position generally below and slightly forward of the ankle protuberances is positioned rearwardly of, and slightly below, the medial edge of the shell, the lateral edge of the shell, or both, as shown in FIG. 6. In FIG. 4, the cable is seen extending into the boot between the shell 12 and the tongue 14 toward the recessed positions of the opposed lower apertures 181, 182 of the respective lower anchor channels 178, 180.

An intermediate segment of the upper cable, sometimes also referred to as a lower segment 111 (e.g., of the upper cable), extends between the respective medial and lateral apertures 181, 182 defined by the lower anchor channels 178, 180 for the upper cable 110. For ease of reference, the intermediate segment 111 of the upper cannel can be considered as extending between opposed portions of the upper cable.

In some embodiments, the lower segment 111 of the upper cable 110 extends from the position 181, 182 generally below and slightly forward of the ankle protuberances in correspondence to a flexible region 185 of the boot, as shown in FIGS. 4 and 6. The flexible region 185 of the boot can be positioned to correspond to a position of the wearer's flexible ankle joint. With such an arrangement of the upper cable 110 (e.g., an arrangement in which the lower segment extends from the lower channel as a position "deep within the boot"), a selected tension in the upper cable can urge an upper portion of the floating element 150 downwardly and rearwardly against the tongue, urging a wearer's foot downwardly into the foot bed and rearwardly into the heel cup, with greater force T1*a* as compared to an arrangement in which the cable was routed into an anchor channel having an aperture positioned directly adjacent an edge of the shell.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

Any patent and non-patent literature cited herein is hereby incorporated by references in its entirety for all purposes.

As used herein, "and/or" means "and" or "or", as well as "and" and "or." Moreover, any and all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of lending systems and other systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under U.S. patent law, unless the element is expressly recited using the phrase "means for" or "step for".

The inventors reserve all rights to the subject matter disclosed herein, including the right to claim all that comes within the scope and spirit of the following claims.

The invention claimed is:

1. An item of footwear with a tensioning system, comprising:

a shell configured for enclosing a foot and at least a portion of a lower leg;

the shell having a pair of opposing edges generally aligned along a top-of-foot portion of the shell and/or a front-lower-leg portion, the edges generally configured to align with a longitudinal axis of a wearer's foot and/or lower leg, the opposing edges defining opposite sides of the shell;

a closure system adjacently associated with the opposing edges for drawing the opposing edges toward one another;

an instep area comprising a tongue positioned in a gap between the opposing edges;

a foot retraction system comprising a tension path, a pressure-distribution element free-floating from the tongue, and at least two anchor points disposed along the path on the opposite sides of the shell and supporting at least one tensionable cable section disposed along the path, a first anchor point comprising a tensioning mechanism, the tensioning mechanism configured to adjust tension in the tensionable cable section, a second anchor point being arranged on the shell, at least one of the anchor points being positioned on a lateral or a medial side of the footwear;

wherein a section of the tension path transversely crosses the instep area of the item of footwear at and through the pressure-distribution element disposed between the opposing edges, the tensionable cable section crossing over an outer surface of the instep area and under the closure system, the opposing edges and an inner surface of the shell to apply a selectable force magnitude and force direction to the instep area, providing a selectable degree of downward and rearward seating of the wearer's foot and heel in the item of footwear; and the tensionable cable section can be tensioned over the instep area independently of the closure system for drawing the opposing edges towards one another.

2. The item of claim 1, wherein the item comprises a boot for a snow or skating sport.

3. The item of claim 1, wherein the tension path includes at least a third anchor point disposed on the footwear and positioned to provide a routing of the tension path with an upward turn along a side of the item after crossing the instep area.

4. The item of claim 3, wherein the tension path continues to a position rearward that is longitudinally aligned with an ankle area of the footwear.

5. The item of footwear of claim 4, wherein the tension path is routed completely around a rearward portion of the shell from the medial and lateral sides.

6. The item of footwear of claim 5, wherein the tension path is routed to be disposed between the intended wearer's Achilles tendon and medial protuberance of the ankle.

7. The item of claim 1, wherein the tension path extends substantially vertically along a region adjacent an ankle area of the footwear.

8. The item of claim 1, wherein the tension path extends adjacent a heel area of the footwear.

9. The item of claim 1, wherein the tension path on at least one side of the footwear terminates at the tensioning mechanism disposed on the footwear above a region adjacent an ankle area of the footwear.

10. The item of claim 1, wherein the tensioning mechanism comprises a reel-based mechanism.

11. The item of claim 1, wherein the tension path is routed to transversely cross a wearer's foot and continue rearwardly at about 20 to about a 70 degree angle from horizontal to apply a rearward and downward force vector on the wearer's foot and/or lower leg.

12. The item of claim 1, wherein a section of the tension path is disposed outwardly of an outer surface of the tongue.

13. The item of claim 12, wherein the tension path extends from outwardly of the tongue to a region positioned inwardly of an outer surface of the outer shell.

14. The item of claim 1, wherein the closure system comprises a set of closure elements arranged along the opposing edges.

15. The item of claim 14, wherein the closure elements are adapted to receive laces or other cables.

16. The item of claim 15, further comprising a removable bootie disposed in the shell, and a portion of the bootie is disposed in the instep area and the tension path routes over the portion.

17. The item of claim 16, wherein the tensioning mechanism includes a wheel or knob operable by a user to tension the tensionable cable section.

18. The item of claim 1, wherein the tensionable cable section is configured to have two free ends coupled to the first anchor point comprising the tensioning mechanism disposed on one of the opposing sides of the footwear, the tensioning mechanism being spaced away from and rearward of the opposing edges associated with those sides; and a closed loop end engaging the second anchor point on the opposite side of the footwear, and also spaced away and rearward of the opposing edges.

19. The item of footwear of claim 1, wherein the tensionable cable section is configured so that the tensioning of the tensionable cable section applies a rearward and downward force vector on the wearer's foot and/or lower leg.

20. The item of footwear of claim 1, wherein the pressure distribution element is configured to be at least one of vertically or laterally repositioned.

21. The item of footwear of claim 1, wherein the pressure distribution element comprises channels through which the at least one tensionable cable section is routed.

* * * * *